US005437140A

United States Patent [19]

Molinaro

[11] Patent Number: 5,437,140

[45] Date of Patent: Aug. 1, 1995

[54] AUTO ROTATION CAPPING CHUCK IMPROVEMENT

[75] Inventor: Luca Molinaro, New Castle, Pa.

[73] Assignee: Portola Packaging, Inc., San Jose, Calif.

[21] Appl. No.: 176,653

[22] Filed: Jan. 3, 1994

[51] Int. Cl.[6] ..... B67B 3/20; B67B 3/28; B65B 7/28

[52] U.S. Cl. ..... 53/331.5

[58] Field of Search ..... 53/331.5, 317, 367, 53/305

[56] References Cited

U.S. PATENT DOCUMENTS 3,771,284 11/1973 Boeckmann et al. .
3,906,706 8/1975 Conti .
3,984,965 10/1976 Sonnenberg ..... 53/331.5
4,178,733 12/1979 Dankert .
4,485,609 12/1984 Kowal ..... 53/331.5
4,922,684 5/1990 Nelson .
4,939,890 7/1990 Peronek et al. .
5,313,765 5/1994 Martin ..... 53/331.5 X

*Primary Examiner*—Horace M. Culver
*Attorney, Agent, or Firm*—Julian Caplan; Flehr, Hohbach, Test, Albritton & Herbert

[57] ABSTRACT

An auto rotation capping device for use on bottle cappers to provide for a final partial tightening rotation of a pre-positioned tamper evident push on cap. The auto rotation cap tightening device includes a support and guide housing with a recessed cap engagement chuck that imparts partial rotation to the cap by the vertical movement of the bottle cap against the chuck.

10 Claims, 2 Drawing Sheets

AUTO ROTATION CAPPING CHUCK IMPROVEMENT

BACKGROUND OF THE INVENTION

1. Technical Field

In the dairy industry, plastic tamper evident snap on screw off caps are used in conjunction with blow molded plastic milk containers due to numerous advantages such as cost and durability. Conventional capping machines initially position the cap on the bottle neck and "snap" it vertically down thereon over the registering threads of the cap and bottle. A tamper evident band on the cap prevents non-user removal of the cap prior to consumer purchase and use. While a fluid tight seal is normally achieved during the initial "snap" on some rotational looseness of the cap sometimes occur between the cap and the bottle neck which is non-desirous. Partial tightening rotation of the cap after sealing is often required and is the subject of this invention.

2. Description of Prior Art

Prior art devices of this type have been directed to snap on screw off cap configurations that require full cap rotation to achieve a desired seal between the cap and the bottle neck. Various capping machines and associated cap chucks have been designed to engage and rotate caps on the bottle necks as they pass down the production line. Most capping devices are directed to engagement of the pre-position cap and descend thereon rotating same to achieve a "tight" seal. Alternately, capping chucks are typically continuously rotated so that as the cap and bottle are engaged cap rotation takes place, see for example U.S. Pat. Nos. 4,939,890, 4,922,684, 4,178,733, 3,906,706 and 3,771,284.

In U.S. Pat. No. 4,939,890 an anti-rotation method and apparatus for bottle capping machines is disclosed. A guide is provided to prevent rotation of the bottle as the cap is rotated thereon.

U.S. Pat. No. 4,922,684 is directed to a cap and cap applicator that positions and initially rotates the cap by engagement of a cap engagement textured bar.

U.S. Pat. No. 4,178,733 discloses a torque open cap chuck improvement wherein a ball is inserted within and between a portion of a chuck jaw to prevent jaw twist and cocking of same. The ball resist twisting by displacing the lateral forces inherent therein.

U.S. Pat. No. 3,984,965 shows a cap applying device having segmented jaw portions that pivot upwardly upon engagement with a bottle cap, closing over same for rotation of the cap by the Jaw configuration.

U.S. Pat. No. 3,906,706 is a cap tightener having multiple jaw gripping elements that pivot upwardly to engage the cap and rotate same.

U.S. Pat. No. 3,771,284 is a capping apparatus that has a pre-tightener assembly. A cap tightening turret includes a number of spindles with continuous rotating heads. The heads have a frictional engagement ring that grips the cap as it is inserted into the head. A spindle head rotates the ring assembly, tightening the cap.

SUMMARY OF THE INVENTION

An auto rotation capping chuck to tighten caps that are pre-positioned and in sealing relation on bottles by bottle induced rotation. The capping device is engaged and activated by the bottle cap and neck as it ascends vertically into the capping device frictionally holding the cap and rotating same as the chuck of the device moves vertically with the cap inducing a limited spiral rotation as it ascends therewith to the cap.

DESCRIPTION OF THE PREFERRED EMBODIMENT

Figure 1:
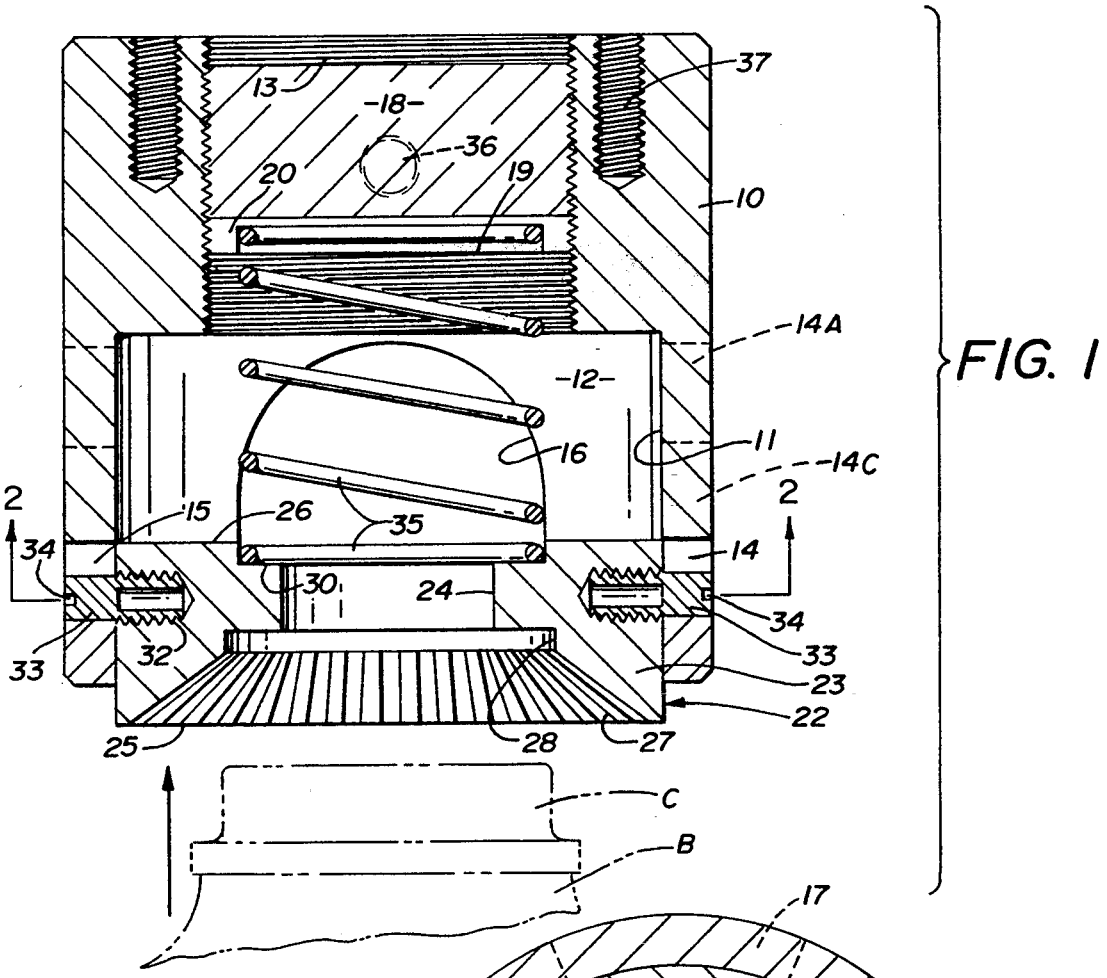
FIG. 1 is a cross-sectional view on lines 1—1 of FIG. 2.
Figure 2:
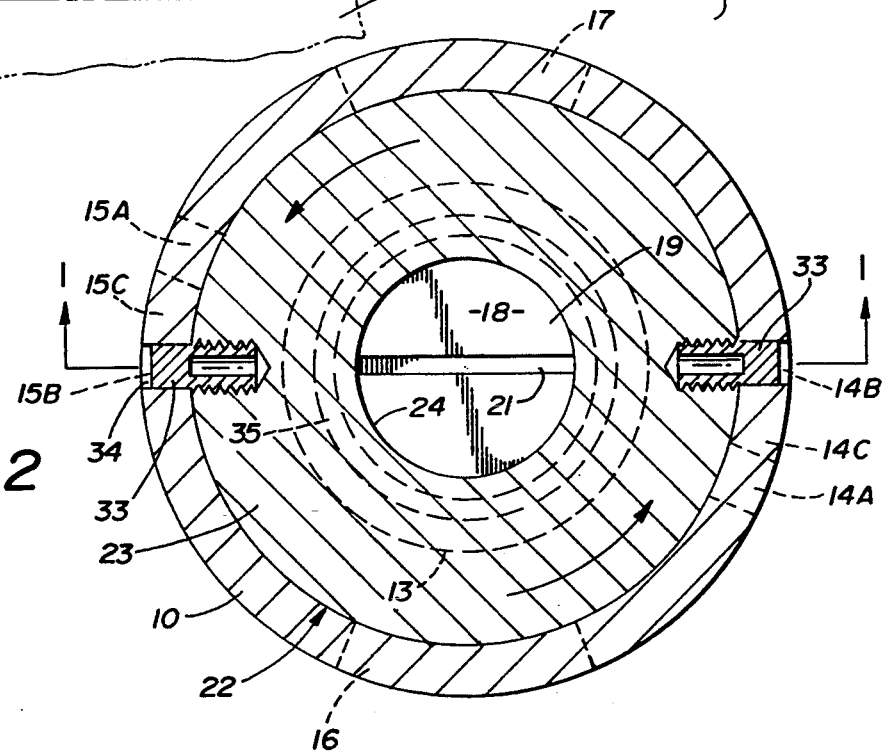
FIG. 2 is a cross-sectional view on lines 2—2 of FIG. 1.
Figure 3:
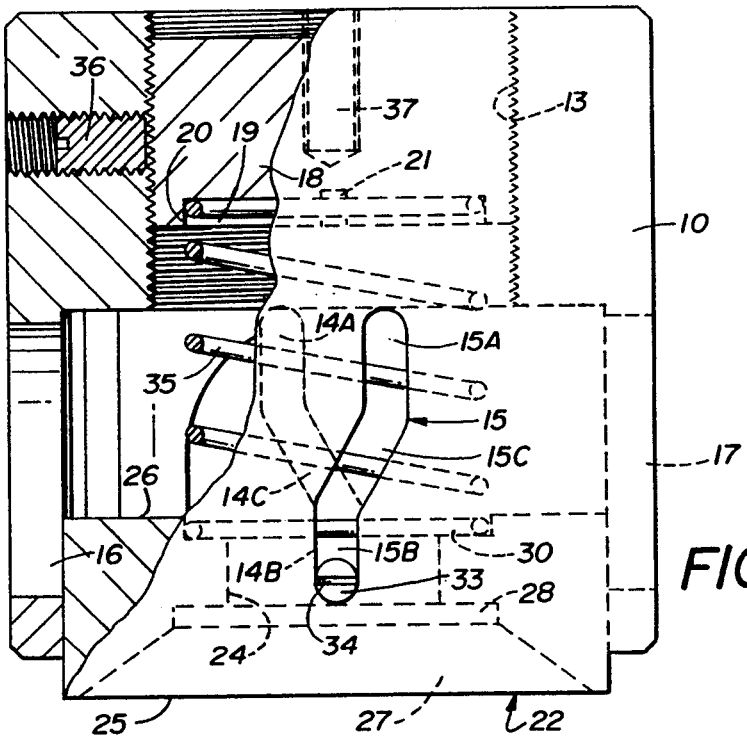
FIG. 3 is a partial cross-sectional view of the capping device.

A capping chuck device of the invention can be seen in FIGS. 1, 2, and 3 of the drawings comprising a cylindrical support housing 10, centrally apertured at 11 defining a circular cavity 12 with an area of reduced transverse internal dimension at 13. A pair of oppositely disposed vertically extending elongated guide openings 14 and 15 are formed within said support housing 10 adjacent to and in communication with the circular cavity 12 hereinbefore described. A pair of oppositely disposed access openings 16 and 17 are positioned within the support housing 10 between said respective guide openings 14 and 15 and are defined as generally rectangular in nature for access to the circular cavity 12.

An adjustment screw 18 is threadably engaged within the area of reduced transverse dimension at 13 as best seen in FIGS. 1–3 of the drawings. The adjustment screw 18 has an annular recessed area at 19 inwardly of one end defining an annular upstanding rib 20 forming a spring seat within.

An adjustment notch 21 within the adjustment screw 18 intersects said recessed area 19 and the annular rib 20 respectively.

A chuck 22 is movably positioned within the circular cavity 12 having a main cylindrical body member 23 which is centrally apertured at 24 inwardly from its respective outer opposing surfaces 25 and 26. A fusto-conical recess 27 extends inwardly from said outer surface 25 terminating at an annular cap engagement recess 28 which is centered on said aperture at 24. The respective interior annular surfaces of said cap engaging recess 28 and fusto-conical recess 27 are ribbed vertically defining a tapered cap guide surface area and cap engagement area thereon.

A spring engagement annular recess 30 is positioned within the outer surface 26 of the chuck 22 about said central aperture at 24 opposite said cap engagement area. The spring engagement annular recess 30 is vertically aligned with said annular recess area 19 in the adjustment screw 18 hereinbefore described.

The capping chuck 22 has oppositely disposed horizontally aligned threaded cavities 31 and 32 in its main cylindrical body member 23 to receive outwardly extending respective guide pins 33 portions of which are threaded at 34 for registration within said respective cavities 31 and 32. The guide pins 33 extend for guiding registration within said respective elongated vertically offset apertures 14 and 15 in the cylindrical support housing 10. Each of said openings 14 and 15 have a vertical offset portion 14A and 15A that is interconnected to an initial pin engagement portion 14B and 15B by angular guide openings 14C and 15C therebetween. The respective angular guide openings 14C and 15C extend in opposite lateral alignment so that the resulting vertical offset portions 14B and 15B are oppositely offset in annular relation to one another as best seen in FIG. 2 of the drawings in solid and dotted lines respectively.

An engagement spring 35 is seated between said adjustment screw 18 and said chuck 22 to provide adjustable spring resistance to said chuck 22 and will be heretofore described.

Referring to FIGS. 1 and 3 of the drawings, a set screw 36 can be seen extending through an aperture in the support housing 10 engaging the adjustment screw 18. Threaded mounting holes 37 extend vertically into the support housing 10 which are used in securing the capping chuck device to a capping machine system (not shown) that is well known and understood by those skilled in the art.

Figure 4:
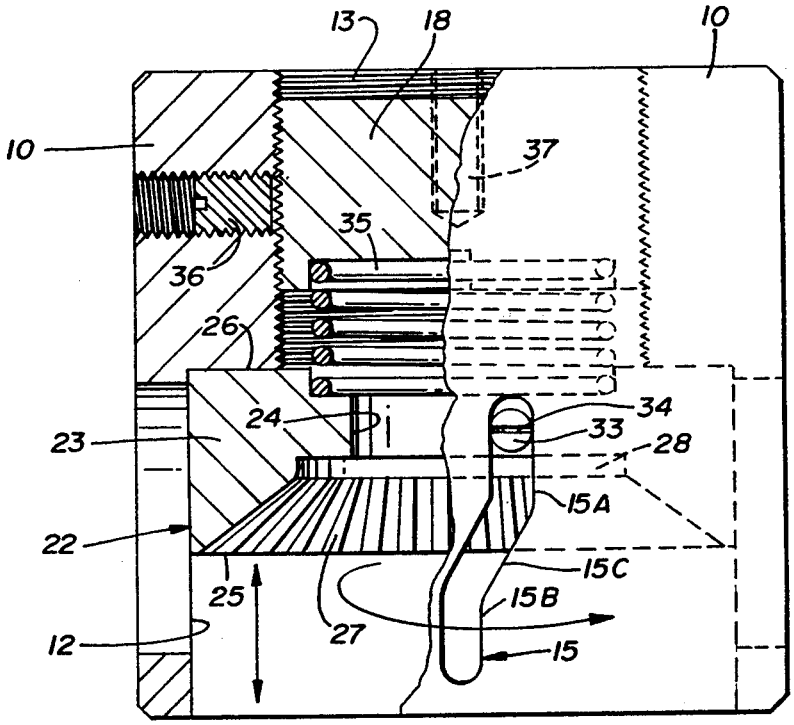
FIG. 4 is a partial cross-sectional view of the capping device in activated fully rotated position.

In operation, the auto rotation capping device of the invention is engaged by a vertically ascending cap C and bottle B shown in broken lines in FIG. 1 of the invention. The cap C is guided to registering engagement within the fusto-conical recessed area 27 to the cap engagement recess 28. As the cap C and bottle B continue to ascend vertically, the chuck 22 is driven spirally inward within the fixed cylinder and support housing 10 guided by the respective guide pins 34 extending therefrom which follow in the registering offset elongated guide openings 14 and 15 as clearly seen in FIGS. 3 and 4 of the drawings. The imparted spiral action to the chuck 22 as it ascends within the support housing 10 provides a partial rotation to the engaged cap C, tightening same against the bottle B if necessary. The chuck 22 advances against the spring resistance of the spring 35 which once the cap C and bottle B descends, repositions the chuck 22 for the next cap C and bottle B.

The random amount of tightening requirement of the cap C is defined in that some of the cap's C require the full rotational range imparted by the chuck 22 while other caps C need only partial rotation due to the random pre-positioning and "snap" of the cap C on the bottle B initially.

During partial rotation range requirement the upper portion of the bottle B deflects absorbing the rotational force and assures each cap is properly tightened thereon.

It is important to note that the caps are initially sealed when first "snapped" down onto the bottles B so that the randomly required partial rotation to tighten same is ancillary to the sealing aspect of the closure system in general.

It will be evident from the foregoing that modifications to the elongated guide openings 14 and 15 within the cylindrical housing 10 can be made to achieve greater rotation of the chuck 22 as it ascends, if required.

Thus, it will be seen that a new and useful device for post tightening "snap on" tamper evident caps has been disclosed which utilizes the guiding registration and relative rotational movement of the cap C to impart a partial rotational tightening of the cap C to the bottle B. It will be obvious to those skilled in the art that various changes and modifications may be made therein without departing from the spirit of the invention.

Therefore I claim:

1. A device for engaging the exterior of an interiorly threaded tamper evident bottle cap pre-positioned on a bottle and selectively tightening said cap comprising a support and guide housing; a cap chuck axially movable relative to said support and guide housing positioned within said support and guide housing, said cap chuck having a fusto-conical guide recessed area for initial engagement with said cap, an annular cap engagement recess inwardly of said fusto-conical recess for rotational registration with said cap, adjustable resilient means engageable on said chuck, access openings in said support and guide housing defining a first and second cavity within, and cooperating means on said chuck and said housing to cause limited relative rotational movement of said chuck and said housing upon vertical movement of said chuck relative of said housing.

2. The device set forth in claim 1 wherein said cap chuck and said support and guide housing are cylindrical.

3. The device set forth in claim 1 wherein said fusto-conical recess and said annular cap recess are ribbed on their interior surface.

4. The device set forth in claim 1 wherein said cooperating means comprises guide pins extending from said cap chuck, said guide pins being oppositely disposed, said guide pins being registerable within vertically offset elongated openings in said guide and support housing.

5. A device as set forth in claim 4 wherein said vertical offset elongated openings comprises a first vertical offset portion, a second vertical offset portion, and an intermediate interlinking angularly aligned guide portion between said first and second vertical offset portion.

6. The device set forth in claim 1 wherein said adjustable resilient means engaging on said chuck comprises an adjustment screw within said support housing in spaced vertical relation to said cap chuck, a spring interengaging said adjustment screw and said cap chuck, and means for selectively advancing said adjustment screw within said first cavity in said support housing.

7. A device for engaging the exterior of a threaded bottle cap pre-positioned on a bottle and for selectively tightening said cap comprising a cap chuck member shaped to engage said cap, a support and guide housing member surrounding said chuck and vertically moveable relative thereto, cooperating means on said chuck member and said housing member to cause limited rotational movement of said chuck member relative to said housing member upon vertical movement of said chuck member relative to said housing member and resilient means biasing said chuck member outwardly relative to said housing member.

8. A device according to claim 7 in which said resilient means is adjustable.

9. A device according to claim 7 in which said cooperating means comprises a substantially radial pin in one said member, the other said member being formed with an opening to receive said pin, said opening being formed at least partially with a slanted stretch.

10. A device according to claim 9 in which said opening is formed with a first vertical stretch above said slanted stretch and a second vertical stretch below said slanted stretch.

* * * * *